US006644772B2

(12) United States Patent
Choi

(10) Patent No.: US 6,644,772 B2
(45) Date of Patent: Nov. 11, 2003

(54) INKJET MULTIFUNCTION DEVICE HAVING A NOZZLE MALFUNCTION REPAIR FUNCTION AND A METHOD FOR MAINTAINING THE SAME

(75) Inventor: Seung-Young Choi, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/983,059

(22) Filed: Oct. 23, 2001

(65) Prior Publication Data

US 2002/0171699 A1 Nov. 21, 2002

(30) Foreign Application Priority Data

May 16, 2001 (KP) ..... 2001/26590

(51) Int. Cl.[7] ..... B41J 29/393; B41J 29/38; B41J 2/165

(52) U.S. Cl. ..... 347/19; 347/14; 347/23; 347/35; 347/5

(58) Field of Search ..... 347/19, 14–17, 347/23, 9–12, 15, 40, 41, 35, 85, 86, 84, 5; 358/1.14

(56) References Cited

U.S. PATENT DOCUMENTS 5,748,206 A * 5/1998 Yamane ..... 347/37
6,164,750 A * 12/2000 Subirada et al. ..... 347/14
6,215,557 B1 * 4/2001 Owens ..... 358/1.14
6,273,542 B1 * 8/2001 Couwenhoven et al. ..... 347/19

* cited by examiner

*Primary Examiner*—Stephen D. Meier
*Assistant Examiner*—Charles W. Stewart, Jr.
(74) *Attorney, Agent, or Firm*—Robert E. Bushnell, Esq.

(57) ABSTRACT

Disclosed are an inkjet multifunction device having a function of attempting to correct malfunctioning nozzles. The inkjet multifunction device includes a printing unit for printing a test pattern, a scanner for scanning the printed test pattern, and a control unit for determining whether respective nozzles in the printing unit malfunction based on the scanned test pattern. The control unit controls the printing unit in order for the nozzles determined as malfunctioned to perform spitting. The determination on whether the nozzles malfunction and the purging of the nozzles are repeatedly performed by the predetermined number of times, and the test step stops if it is determined that all the nozzles normally operate after the repetition operation. Paper and ink can be saved since the purging is selectively performed only on nozzles deemed to be malfunctioning, and meaningless testing and purging operations are prevented from occurring in the case of where there is an absence of malfunctioning nozzles.

33 Claims, 3 Drawing Sheets

INKJET MULTIFUNCTION DEVICE HAVING A NOZZLE MALFUNCTION REPAIR FUNCTION AND A METHOD FOR MAINTAINING THE SAME

CLAIM OF PRIORITY

This application makes reference to, incorporates the same herein, and claims all benefits accruing under 35 U.S.C. §119 from my application entitled INKJET MULTIFUNCTION DEVICE CAPABLE OF REPAIRING MALFUNCTION OF A NOZZLE, AND A METHOD FOR MAINTAINING THE SAME filed with the Korean Industrial Property Office on May 16, 2001 and there duly assigned Serial No. 2001-26590.

BACKGROUND OF THE INVENTION

1. Field of the Invention

The present invention relates to an inkjet correction device equipped with a scanner, a printing unit, and so on, and more particularly to an inkjet correction device having a function for repairing malfunctioning nozzles performing printing operations and a method for detecting the malfunctioning nozzles.

2. Description of the Related Art

An inkjet correction device, named a multifunction peripheral (MFP) or a multifunction device (MFD), refers to a multifunction product devised to enable additional functions related to printing at the same time with performing the functions of an inkjet printer. Such inkjet multifunction device, in general, includes a printing unit for printing certain shapes on sheets of paper, a scanner for scanning images and providing the scanned images to the printing unit, and a fax unit for receiving fax data transferred through the public switched telephone network and providing the received fax data to the printing unit, and the like.

The printing unit in the inkjet multifunction device is provided with a head having plural nozzles to perform printing jobs by jetting ink. During the repeated ink-jetting performance of the nozzles for printing jobs, nozzle-aging or other various factors cause the nozzles to malfunction in their performance of normal ink-jetting operations. If any of the nozzles is malfunctioning in its normal ink-jetting operations, white lines become present on printed output images.

The most common cause for a nozzle to malfunction is that the nozzle becomes clogged. In order to repair the malfunctioning nozzles, a method for the nozzles to purge with ink is employed in the conventional art. The purging is repeated the predetermined number of times, and, if the clogged nozzles are unclogged by the repeated spitting, the nozzles normally work on printing jobs when performing future printing jobs.

However, in the conventional method for repairing the malfunctions of nozzles as stated above, there exists a problem in that ink is wasted a lot since the purging is performed on all the nozzles in the head even in case that one or some of the nozzles are malfunctioning. Further, in case that ink is smoothly jetted with the nozzles repaired by the purging, paper, time and ink are wasted since the purging is repeatedly performed a predetermined number of times, regardless of whether the clog is fixed early in the purging process.

SUMMARY OF THE INVENTION

The present invention has been devised to solve the above problems, so it is an object of the present invention to provide a inkjet multifunction device capable of effectively repairing malfunctioning nozzles and prevent wasting of ink, paper, and time by selectively performing the purging only to malfunctioning nozzles.

In order to achieve the above object, an inkjet multifunction device according to the present invention includes a print unit equipped with plural nozzles for printing a certain test pattern on paper, a scanner for scanning the test pattern printed on the paper and a control unit for determining whether or not the respective nozzles malfunction based on the test pattern the scanner scans, and controlling the printing unit to purge only the malfunctioning nozzles.

Here, the control unit determines which nozzles are functioning nozzles corresponding to parts where colored dots are present out of parts of the test pattern, and deems a nozzle to be functioning if the corresponding part of the test pattern has a color brightness which is over a certain level.

In the meantime, the control unit repeatedly performs the control operation of the printing unit by a predetermined number of times to determine which nozzles are malfunctioning and purging only the defective nozzles of the printhead, stops the test steps for repairing nozzles if it is determined that all the nozzles normally operate after repetitive purging operations, and indicates to an external personal computer 33 and/or a display unit 51 in case that malfunctioning nozzles remain.

The test pattern includes a predetermined reference image being a reference for determining positions of an image to be tested, and the control unit determines a corresponding relation between the nozzle locations and parts of the image to be tested. Accordingly, the control unit exactly detects which nozzles are malfunctioning nozzles through the scanned image.

In the meantime, according to the present invention, a method for repairing malfunctioning nozzles in an inkjet multifunction device is provided which includes the steps of printing a predetermined test pattern on paper, scanning the printed test pattern; determining whether respective nozzles in a printing unit malfunction based on the scanned test pattern and performing a controlled, efficient purging of only the nozzles designated as being malfunctioning.

According to the present invention, the repair of the malfunction nozzles can effectively implemented by selectively performing ink purging only to malfunctioning nozzles, and the repetition of meaningless testing jobs can be prevented in case that the nozzles are all repaired.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
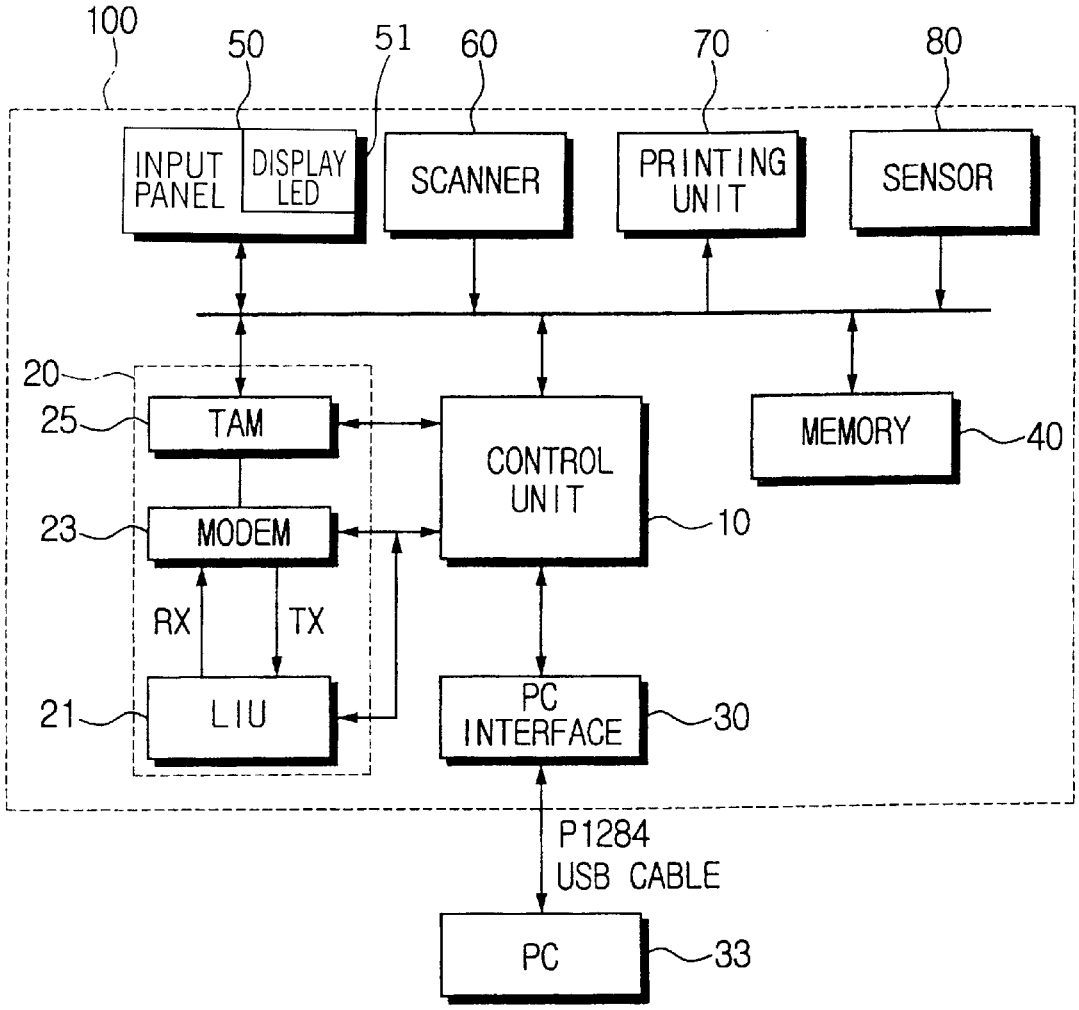
FIG. 1 is a block diagram for showing an inkjet multifunction device according to an embodiment of the present invention.

FIG. 1 is a block diagram of an inkjet multifunction device according to an embodiment of the present invention. An inkjet multifunction device 100 has an interface 30 for interfacing with a personal computer 33, a fax unit 20 for receiving fax data from an external public switched telephone network, a scanner 60 for scanning images expressed on paper and so on, and a printing unit 70 for receiving data on images transferred from the personal computer 33, fax unit 20, scanner 60, and so on and printing the transferred images on paper. Further, the inkjet multifunction device 100 includes a control unit 10 for controlling plural peripheral devices as mentioned above, a memory unit 40 for temporarily storing data transferred from the scanner 60, fax unit 20, personal computer 33, and so on, a sensor 80 for sensing operation states of the respective peripheral devices, an input panel 50 equipped with several user actuated buttons and for enabling users to set and manipulate various functions, and so on.

The fax unit 20 has an LIU 21 connected to the external public switched telephone network, a modem 23 for receiving and transferring data through the LIU 21, a telephone answering machine 25 (TAM) for providing automatic response functions, and so on. Fax data received through the public switched telephone network (PSTN) is transferred to the control unit 10 through the LIU 21 and modem 23, and the transferred fax data is stored in the memory unit 40. The data stored in the memory 40 is transferred to the printing unit 70 according to a control of the control unit 10, and the printing unit 70 prints the fax data transferred.

The printing unit 70 has one or two heads, and each head includes plural nozzles for jetting ink. In general, in case of one head provided, one head has a function of printing both color images and monochromatic images, and in case of two heads provided, one head is used for printing monochromatic images, and the other for color images. The printing unit 70, described later in detail, has a function of producing a test pattern for detecting malfunctioning nozzles.

The scanner 60, like as a general scanner, has a function of scanning images printed on paper and converting the scanned images into digital data. The scanned data is temporarily stored in the memory unit 40, and the data stored in the memory unit 40 is transferred to the printing unit 70 for printing, or to the personal computer 33 for storage or editing through the PC interface 30 according to a control of the control unit 10. The scanner 60, described later in detail, provides to the control unit 10 the data obtained from the scanning of the test pattern which the printing unit 70 outputs to enable the control unit 10 to determine which nozzles are malfunctioning.

The sensor 80 detects whether operations of the peripherals such as the scanner 60, printing unit 70, interface 30, fax unit 20, and so on are performing normally. Detected data is transferred to the control unit 10, and the control unit 10 indicates the detected data through a display such as an LCD 51 provided on the input panel 50. Accordingly, a user can notice whether various peripherals are normally operated through the LCD 51.

Figure 2:
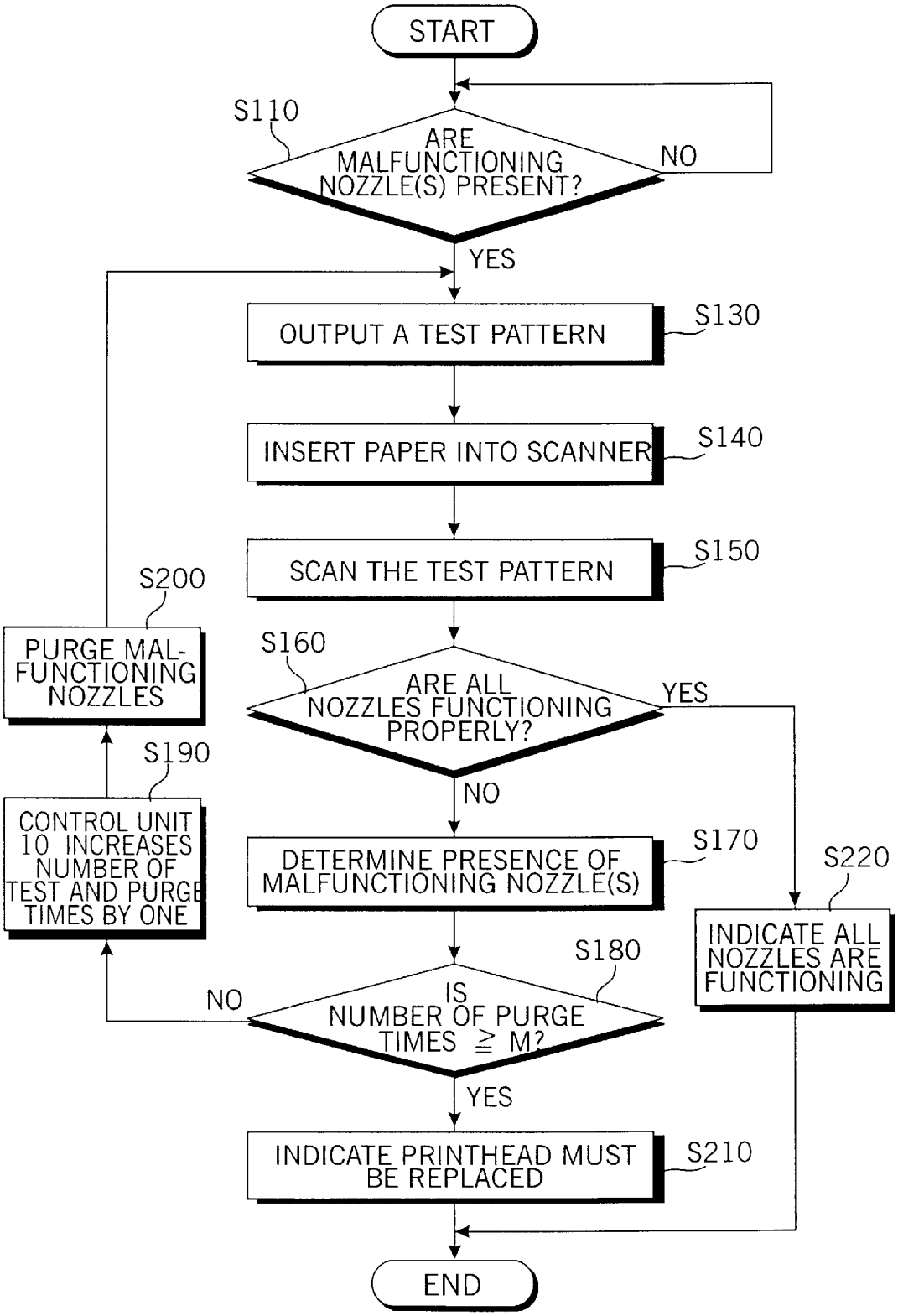
FIG. 2 is a flow chart for showing a method for repairing malfunction nozzles of an inkjet multifunction device according to an embodiment of the present invention.

FIG. 2 is a flow chart for showing a method for repairing malfunctioning nozzles of an inkjet multifunction device according to an embodiment of the present invention. If a user presses a button provided on the input panel 50 for performing a function of repairing malfunctioning nozzles (S110), the control unit 10 controls the printing unit 70 and outputs a test pattern (S130).

Figure 3:
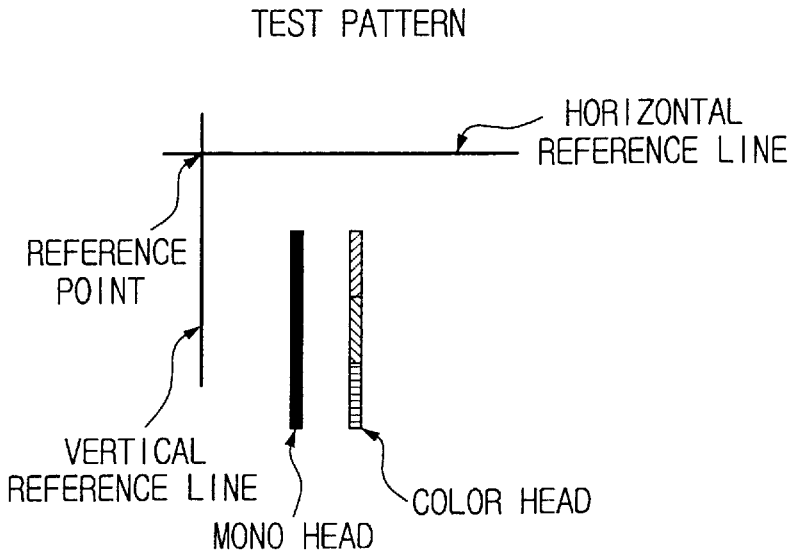
FIG. 3 is a view for showing an example of a test pattern outputted by a printing unit of FIG. 1.

FIG. 3 is a view for showing an example of a test pattern. The test pattern includes a monochromatic image of a bar shape outputted by a monochromatic head and a color image of a bar shape outputted by a color head. The color image is constructed with three portions of red, blue, and yellow colors. Further, the test pattern, as described later, includes a reference image for exactly grasping a position of a scanned test pattern. The reference image is constructed with a vertical reference line and a horizontal reference line which cross at a reference point.

Figure 4:
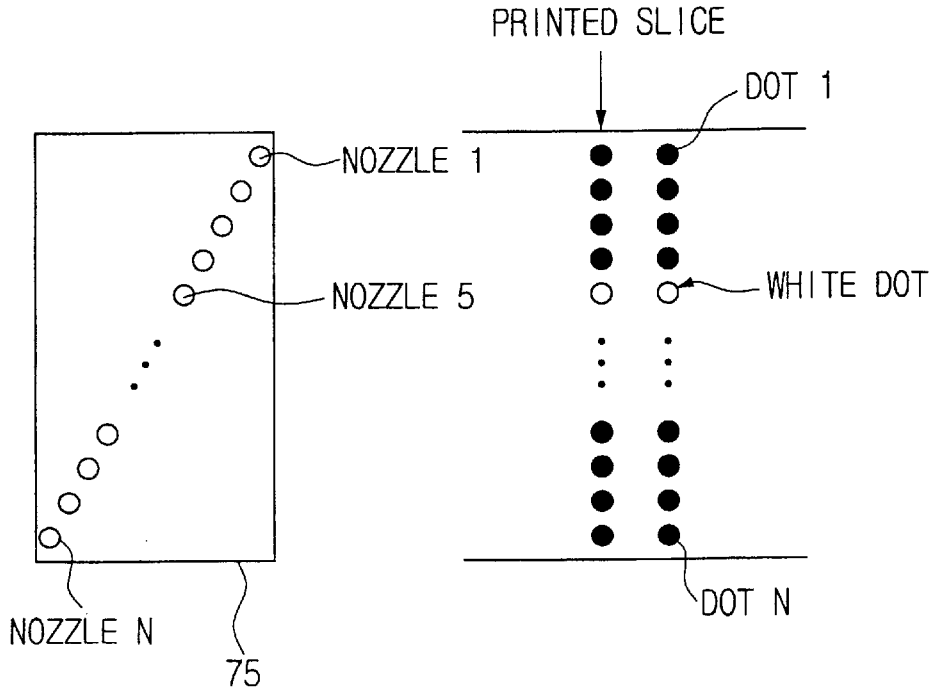
FIG. 4 is a view for schematically showing a correspondence relations of nozzles in a head with dots in a test pattern respectively.

Paper on which the test pattern is outputted is inserted into the scanner 60(S140). A step for inserting the paper into the scanner 60 can be manually done by a user, or automatically inserted into the scanner 60 from the printing unit 70 by separately providing an automatic insertion device. The scanner 60 scans the test pattern printed on paper (S150), and the scanned data is transferred to the control unit 10. The control unit 10 determines whether nozzles are normally operated based on the data transferred from the scanner 60(S160). The determination on whether the nozzles are normal is performed through the steps as follows. First, the control unit 10 determines precise reference positions of a reference image, that is, a mono image and a color image to be tested by using the vertical reference line and the horizontal reference line. That is, the control unit 10 determines exact positions of respective parts of the mono image and color image through relative positions with respect to the reference point. Therefore, nozzles corresponding to the respective parts can be matched. As shown in FIG. 4, N nozzles exist in one head 75, and, if each slice of the test pattern is enlarged for an illustration, each slice is constructed with N dots expressed by the respective nozzles. Accordingly, by exactly determining the positions of the respective dots of an image to be tested as above, the numbers of nozzles corresponding to the respective dots can be exactly detected. If all dots are expressed in black, the control unit 10 determines that the ink-jetting operations of all the nozzles are functioning normally, and indicates on display 51 located near input panel 50 that the head is functioning properly (S220).

If part of the dots are expressed not in black but in white, the control unit 10 can determine that the ink-jetting operations of the nozzles corresponding to the white dots are malfunctioning. That is, as shown in FIG. 4, if the fifth dot is expressed in white, the control unit 10 can determine that the fifth nozzle corresponding to the fifth dot is malfunctioning.

In a different embodiment, instead of determining malfunctioning nozzles only in case of the white color, it can be determined as the malfunction nozzles in case that brightness is less than a certain level. In a case that a nozzle jets ink but jets an insufficient amount of ink, that nozzle is deemed to be malfunctioning. In case that the brightness of each dot is below a certain level, the control unit 10 determines that the nozzle is malfunctioning. As stated above, the determination on whether or not a nozzle malfunctions with reference to brightness can be applied to both a monochromatic head case as well as a multi-colored head.

If the control unit 10 determines that nozzles malfunction, the control unit 10 determines if the number of purge times is more than the predetermined number of times (M) (S180). In case that the number of purge times is less than the predetermined number of times (M), the control unit 10 increases the number of purge and test times by one (S190) and then performs a purging operation to only the malfunctioning nozzles still present (S200). Thereafter, the control unit 10 repeatedly performs step S130 through step S160 for determining the continued presence of malfunctioning nozzles.

During the repeated performance, if it is determined that all the nozzles are functioning properly, the control unit 10 indicates on the display 51 that the head is normal as stated above, and, in case that malfunctioning nozzles are present, the control unit 10 repeats the testing and purging steps as stated above. If malfunctioning nozzles are still detected in case that the number of testing and purging times reaches the predetermined number of times (M), the control unit 10 stops the testing and purging sequences and indicates that the printhead must be replaced on the display 51. The number of repeat times can be arbitrarily or experimentally set, but, preferably M is set to four, which is in general the appropriate number of times in repairing malfunctioning nozzles by purging.

By the above method, in case that there is an absence of malfunctioning nozzles, the control unit 10 stops the testing and purging steps to prevent the repetitions of meaningless testing and purging operations. If malfunctioning nozzles persist after the first purge, repurging of only the malfunctioning nozzles still present is repeated until either there is an absence of malfunctioning nozzles or the number of purging and testing operations equals a predetermined number M. If M purges have occurred to a malfunctioning nozzle(s) and malfunctioning nozzles are still present, an indication is made on display panel 51 that the printhead needs to be replaced because the purging operations were unsuccessful in unclogging all of the malfunctioning nozzles.

According to the present invention, the maintenance of malfunctioning nozzles can be effectively performed by selectively performing purging operations to only malfunctioning nozzles. Accordingly, the waste of ink, paper, and time can be prevented. Further, according to the present invention, in case that there is an absence of malfunctioning nozzles, the repetitions of meaningless testing and purging sequences can be prevented.

Although the preferred embodiment of the present invention has been described, it will be understood by those skilled in the art that the present invention should not be limited to the described preferred embodiment, but various changes and modifications can be made within the spirit and scope of the present invention as defined by the appended claims.

What is claimed is:

1. An inkjet multifunction device, comprising:

a printing unit equipped with a plurality of nozzles, and for printing a predetermined test pattern on paper;

a scanner for scanning the test pattern printed on the paper; and a control unit for determining whether ones of said plurality of nozzles malfunction based on the test pattern and the scanning, and controlling the printing unit so that only those ones of said plurality of nozzles that are deemed as malfunctioning are purged a first time.

2. The inkjet multifunction device of claim 1, wherein the control unit deems a nozzle as malfunctioning when a brightness of a color of ink of a portion of said test pattern falls below a predetermined threshold.

3. The inkjet multifunction device of claim 1, wherein the control unit repeatedly causes said test pattern to be reprinted, said scanner to scan said reprinted test pattern, redetermination of whether there is still a presence of a malfunctioning nozzle and purging only those nozzles that are still deemed to be malfunctioning when said first purge is unsuccessful in correcting all malfunctioning nozzles in said printing unit.

4. The inkjet multifunction device of claim 3, wherein the control unit controls the printing unit to stop the reprinting and purging of nozzles in case that all of said plurality of nozzles are deemed to be properly functioning.

5. The inkjet multifunction device of claim 3, further comprising a display unit for displaying to a user that the printing unit needs to be replaced after testing and purging a predetermined number of times fails to correct all ones of said plurality of malfunctioning nozzles.

6. The inkjet multifunction device of claim 1, wherein the test pattern includes a reference point from which said control unit and said scanner can determine the precise location on said piece of paper where each corresponding one of said plurality of nozzles is supposed to print said test image.

7. The device of claim 1, said purging being performed in an attempt to repair said ones of said plurality of nozzles deemed as malfunctioning.

8. A method for repairing malfunctioning nozzles in an inkjet multifunction device, comprising steps of:

printing a predetermined test pattern on paper;

scanning the printed test pattern;

determining if there is a malfunctioning nozzle based on the scanned test pattern;

purging only ones of said plurality of nozzles that are deemed to be malfunctioning; and displaying on a display that said inkjet multifunction device is properly functioning if no nozzles are deemed to be malfunctioning.

9. The method of claim 8, wherein the determination step deems a nozzle as malfunctioning when a brightness of a color of ink of a portion of said test pattern falls below a predetermined threshold.

10. The method of claim 8, in the presence of malfunctioning nozzles, further comprising the steps of:

keeping tract of the number of times a purge operation is performed on said printing unit; and repeating the printing step, the scanning step, the determining step and the purging step if said number of purging steps is less than a predetermined number of times.

11. The method of claim 10, further comprising a step for stopping the purging step and repetition step in case that none of said plurality of nozzles are deemed to be malfunctioning.

12. The method of claim 10, further comprising a step for displaying to a user that the printing unit needs to be replaced after testing and purging a predetermined number of times results in a malfunctioning nozzle.

13. The method of claim 12, further comprising the step of informing a personal computer attached to said inkjet multifunction device that said printing unit needs to be replaced as the purging steps failed to clear all malfunctioning nozzles.

14. The method of claim 8, wherein the test pattern includes a reference point from which said control unit and said scanner can determine the precise location on said piece of paper where each corresponding one of said plurality of nozzles is supposed to print said test image.

15. The method of claim 8, further comprising the step of relaying to a personal computer attached to said inkjet multifunction device that said inkjet multifunction device is working properly in the absence of detection of any malfunctioning nozzles.

16. An method for correcting an ink jet printhead, comprising the steps of:

setting a counter to zero;

printing a test pattern using said ink jet printhead having a plurality of nozzles by ejecting ink of a color through each one of said plurality of nozzles;

scanning said test pattern by a scanner;

determining whether there is a malfunctioning nozzle in said ink jet printhead from said scanned test pattern;

displaying that said inkjet printhead has no malfunctioning nozzles when no malfunctioning nozzles are present;

determining whether said counter is less than a predetermined value if a malfunctioning nozzle is present;

displaying a message that a malfunctioning nozzle remains present when said counter equals said predetermined value;

purging only ones of said plurality of nozzles that are malfunctioning when said counter is less than said predetermined value and when there is a malfunctioning nozzle in said ink jet printhead;

incrementing said counter by one when there is a malfunctioning nozzle present; and repeating said method by printing a new test pattern when there is one malfunctioning nozzle present.

17. The method of claim 16, wherein said step of determining whether there is a malfunctioning nozzle present comprises determining whether a brightness of said color of said ink exceeds a predetermined threshold to determine whether a given nozzle is malfunctioning.

18. The method of claim 16, wherein said step of displaying said ink jet printhead has no malfunctioning nozzles further comprises notifying a personal computer attached to a controller controlling said ink jet printhead that said ink jet printhead is functioning properly.

19. The method of claim 16, wherein said step of displaying that a malfunctioning nozzle remains present further comprises notifying a personal computer attached to a controller controlling said ink jet printhead and said display that said ink jet printhead must be replaced.

20. The method of claim 16, wherein said step of displaying that a malfunctioning nozzle remains present further comprises notifying said personal computer and said display of which nozzles are malfunctioning and the quantity of nozzles that are malfunctioning.

21. The method of claim 20, wherein said step of displaying that a malfunctioning nozzle remains present further comprises notifying said display and said personal computer the color of ink that was trying to be ejected from each of said plurality of nozzles.

22. An apparatus for correcting malfunctioning nozzles in an inkjet printhead, comprising:

a printhead having a plurality of nozzles;

a sheet of recording medium having a reference point, wherein said sheet of recording medium has a test pattern printed onto it by said plurality of nozzles, a reference image for each nozzle in said test pattern being a certain, precise distance and direction from said reference point;

a scanner for scanning a test pattern printed by said printhead vis a vis said reference point;

a control unit attached to said printhead and said scanner, said control unit determining precise location of a reference image for each nozzle in said test pattern and determining the presence of a malfunctioning nozzle and conducting purging operations on only those ones of said plurality of nozzles that are deemed to be malfunctioning based on data received from said scanner;

a counter for keeping tract of the number of test patterns printed and the number of purging operations performed, the value of said counter being initially set to zero and being incremented by one each time a purging operation is performed, the value of said counter being compared to a predetermined value to determine when to abort said purging operations and convey to a user that said printhead must be replaced; and a display unit displaying the result of said correction of said ones of said plurality of malfunctioning nozzles to a user upon completion of said testing and purging operations.

23. The apparatus of claim 22, further comprising a personal computer attached to said control unit for receiving results of said purging operations and receiving information on whether said printhead has been fully repaired by said purging operations or whether said printhead must be replaced because a malfunctioning nozzle is still present after said predetermined number of purging operations.

24. The apparatus of claim 22, wherein the control unit determines that a nozzle is not malfunctioning when the brightness of the color of ink being used on said sheet of recording medium of said test pattern exceeds a predetermined threshold.

25. The apparatus of claim 22, wherein said apparatus further comprises:

a facsimile unit connected to said printing unit and said control unit for printing out messages received over a telephone line; and a memory for temporarily storing an image received by said facsimile prior to printing out by said print head.

26. A method for correcting for malfunctioning nozzles in a printhead, comprising the steps of:

printing a first test pattern on a sheet of recording medium using said printhead, said first test pattern being located a precise distance and direction from a first reference point on said sheet of recording medium;

scanning said test pattern;

determining, from precise reference positions on said sheet of recording medium whether each one of a plurality of nozzles from said printhead produces an image exceeding a predetermined threshold for the color of ink being used;

purging only those nozzles that failed to produce an image at a precise location on said sheet of recording medium exceeding a threshold brightness for the color of ink used if a malfunctioning nozzle is present;

displaying a result of said determining step when no malfunctioning nozzles are present;

printing a second test pattern, said second test pattern being located a precise distance and direction from a second reference point on said sheet of recording medium, scanning said second test pattern, and determining which nozzles are still malfunctioning;

determining, from precise reference positions on said sheet of recording medium whether each one of a plurality of nozzles from said printhead produces an image exceeding a predetermined threshold for the color of ink being used;

performing a second purge on only those nozzles deemed to still be malfunctioning;

displaying a result of said determining step when no malfunctioning nozzles are present;

printing a third test pattern, said third test pattern being located a precise distance and direction from a third reference point on said sheet of recording medium, scanning said test pattern, and determining which nozzles are still malfunctioning;

determining, from precise reference positions on said sheet of recording medium whether each one of a plurality of nozzles from said printhead produces an image exceeding a predetermined threshold for the color of ink being used;

performing a third purge on only those nozzles deemed to still be malfunctioning;

displaying a result of said determining step when no malfunctioning nozzles are present;

printing a fourth test pattern, said fourth test pattern being located a precise distance and direction from a fourth reference point on said sheet of recording medium scanning said fourth test pattern, and determining which nozzles are still malfunctioning;

determining, from precise reference positions on said sheet of recording medium whether each one of a plurality of nozzles from said printhead produces an image exceeding a predetermined threshold for the color of ink being used;

performing a fourth purge on only those nozzles deemed to still be malfunctioning;

displaying a result of said determining step when no malfunctioning nozzles are present;

printing a fifth test pattern, said fifth test pattern being located a precise distance and direction from a fifth reference point on said sheet of recording medium, scanning said fifth test pattern, and determining which nozzles are still malfunctioning;

determining, from precise reference positions on said sheet of recording medium whether each one of a plurality of nozzles from said printhead produces an image exceeding a predetermined threshold for the color of ink being used; and displaying a result that said printhead must be replaced if a malfunctioning nozzle still exists and displaying a result that said printhead has been corrected if no malfunctioning nozzles remain after said fourth purge.

27. The method of claim 26, wherein said display displays which nozzles remain malfunctioning after said fourth purge, the color of ink that was to be ejected from said malfunctioning nozzles, and the number of malfunctioning nozzles left after the fourth purge.

28. The method of claim 26, wherein a personal computer connected to said inkjet printhead receives information pertaining to the results of said correction method, comprising whether or not the print head needs to be replaced, displays which nozzles remain malfunctioning after said fourth purge, the color of ink that was to be ejected from said malfunctioning nozzles, the number of malfunctioning nozzles left after the fourth purge, and, in the case no malfunctioning nozzles are present, the number of purges needed to eradicate malfunctioning nozzles.

29. An inkjet multifunction device having repair capability for malfunctioning nozzles, said device comprises:

a printing unit equipped with a plurality of nozzles, said printing unit printing a predetermined test pattern on paper;

a scanner scanning the test pattern printed on the paper; and a control unit identifying ones of said plurality of nozzles deemed to be malfunctioning based on the test pattern and the scanning, the control unit performing a first, single purge operation upon identification of a malfunctioning nozzle in an attempt to repair said ones of said plurality of nozzles deemed to be malfunctioning, said control unit causing said printing unit to print said predetermined test pattern a second time and causing said scanner to scan said second printed test pattern to determine whether or not there is a continued presence a malfunctioning nozzle after said first, single purge, the control unit performing a second, single purge only when a malfunctioning nozzle is found to be present after the first purge.

30. The device of claim 29, said first and said second purge being performed only on nozzles deemed to be malfunctioning.

31. A method for repairing malfunctioning nozzles in an inkjet multifunction device, said method comprising the steps of:

printing a predetermined test pattern on paper;

scanning the printed test pattern;

determining whether or not there is a malfunctioning nozzle based on the scanned test pattern; and performing a first single purge operation only when a malfunctioning nozzle is present;

printing said predetermined test pattern on paper a second time;

scanning said second test pattern;

determining whether or not there is a malfunctioning nozzle after said first purge based on the scanning of the second test pattern; and performing a second single purge operation only when a nozzle is still malfunctioning after said first purge operation.

32. The method of claim 31, said first single purge operation being performed only on nozzles deemed to be malfunctioning in the first determining step.

33. The method of claim 31, said second single purge operation being performed only on nozzles deemed to be malfunctioning after said first single purge operation.

* * * * *